US005295517A

United States Patent [19]

Ahlers

[11] Patent Number: 5,295,517

[45] Date of Patent: Mar. 22, 1994

[54] PROCESS AND DEVICE FOR THE FILLING OF A VESSEL WITH A LIQUID

[75] Inventor: Egon Ahlers, Neutraubling, Fed. Rep. of Germany

[73] Assignee: Krones AG Hermann Kronseder Maschinenfabrik, Neutraubling, Fed. Rep. of Germany

[21] Appl. No.: 957,391

[22] Filed: Oct. 7, 1992

[30] Foreign Application Priority Data

Oct. 11, 1991 [DE] Fed. Rep. of Germany ..... 4133713

[51] Int. Cl.[5] ..... B65B 3/26

[52] U.S. Cl. ..... 141/1; 141/6; 141/39; 141/48; 141/95; 141/83; 141/148; 141/253; 141/277

[58] Field of Search ..... 141/6, 1, 39, 40, 48, 141/95, 83, 148, 149, 150, 152, 253, 275-278

[56] References Cited

U.S. PATENT DOCUMENTS

| | | | |
|---|---|---|---|
| 3,633,635 | 1/1972 | Kaiser | 141/40 |
| 3,699,740 | 10/1972 | Knabe | 141/6 X |
| 4,386,675 | 6/1983 | Ahlers et al. | 141/6 |
| 4,586,548 | 5/1986 | Hinxlage | 141/6 X |
| 4,982,768 | 1/1991 | Ahlers | 141/6 |
| 5,161,585 | 11/1992 | Murao et al. | 141/39 |

FOREIGN PATENT DOCUMENTS

| | | |
|---|---|---|
| 0222208B1 | 10/1986 | European Pat. Off. . |
| 3019489 | 10/1983 | Fed. Rep. of Germany . |
| 3713105 | 12/1990 | Fed. Rep. of Germany . |

*Primary Examiner*—Ernest G. Cusick

*Attorney, Agent, or Firm*—Finnegan, Henderson, Farabow, Garrett & Dunner

[57] ABSTRACT

A process and device for filling a vessel with a liquid. The vessel is placed on a lifting plate and guided up to a filler spout a predetermined distance measured from its base, the vessel's opening being lifted into a sealed filling position below the filler spout. The vessel is filled up to a predetermined filling level by opening a valve associated with the filler spout, whereupon the supply of liquid is terminated, and a volume of liquid still present between the valve and the filling level flows into the vessel. This after-flowing liquid volume is controlled as a function of the vessel height so that in the case of a vessel having a height smaller than a mean vessel height there is an afterflow of a larger volume of liquid than in the case of a greater vessel height where the afterflow is of a smaller volume of liquid.

22 Claims, 2 Drawing Sheets

PROCESS AND DEVICE FOR THE FILLING OF A VESSEL WITH A LIQUID

The invention relates to a process and a device for filling a vessel with a liquid, in which the vessel is placed onto a lifting plate and is guided towards a filler spout up to a predetermined distance measured from its base, the opening of the vessel is being lifted into a sealed filling position below the filler spout, the vessel is filled up to a predetermined filling level by opening a valve associated to the filler spout, whereupon the supply of liquid is terminated and a volume of liquid present between the valve and the filling level continues to flow into the vessel.

The vessels designated in the following as bottles are to be filled with a specific amount of liquid by means of such a process. Deviations from these nominal values indicated on the bottles are permitted within legally prescribed narrow limits.

The nominal value of the amount of liquid is in each case exactly filled into the bottles in the case of a so-called metering filling fixture. Such a filling fixture is of a complex construction due to the advance dimensioning of the amount of liquid and it can only be adapted to different amounts of liquid with considerable expenditure. Therefore, metering filling fixtures for the filling of liquids are rarely used.

It is furthermore known to determine the volume of liquid filled into the bottles by the distance between the bottle opening or base of the bottle with respect to a filling level. The filling level can be determined by specific means such as return gas tube, liquid level sensor or the like. The filling level is determined in such fashion that the nominal value of the volume of liquid is filled in the case of a bottle filled up to the filling level. If the predetermined filling level is reached, the supply of liquid is interrupted by closing a valve or the return gas tube. The liquid still present between valve and liquid level at this point in time, called afterflow volume in the following, continues to flow into the bottle and leads to a higher filling level. If the afterflow volume is taken into consideration when determining the filling level, i.e. the nominal value of the volume of liquid filled, it must not be removed from the bottle after the termination of the filling.

A counter-pressure filling fixture is known from DE 3019 489 C2 , in which an elastic bottle on a lifting plate is lifted up to a lift-limiting, mechanical stop. In this fashion, the distance of the base of the bottle with respect to a filler spout is determined. By lifting the bottle, it gets into sealing abutment with a seal disposed below the filler spout. The distance of base to filler spout is dimensioned in such fashion that the bottle is upset in the longitudinal direction. Then the pressure in the interior of the bottle is increased and it expands. The increased pressure leads to an increasing sealing force and causes a careful filling of the bottle. Depending upon the length of the bottles the mechanical stop can be adjusted to limit the lift.

A centering bell associated to a filling tank is known from DE 3 713 015 C2 which is disposed below a filler spout and is connected with it via an intermediate body. By means of the encompassing of the bottle neck directly below the bottle opening it is lifted up to a predetermined distance with respect to the filler spout and pressed against a sealing element. The intermediate body ensures a perfect emptying of the residual liquid from the hollow space between centering bell and filler spout if the supply of liquid is interrupted. Moreover the pressing pressure of the bottle against the sealing element is to be ensured by means of a differential pressure chamber formed by the intermediate body.

A rotation filling fixture with a lifting means is known from EP 0222 208 B1, by means of which the bottle neck is encompassed and the opening is lifted to a predetermined distance with respect to the filler spout. The lifting means is designed in such fashion that upon the lowering of the bottle after the completion of the filling process a movement being as free from forces as possible is made possible. A centering bell is mounted on the filler spout displaceably with respect to it and is displaced in the direction of the filler spout upon the lifting of the bottle. A seal disposed on the centering bell is sealingly pressed onto the bottle opening by spring elements formed between filler spout and centering bell.

It is disadvantageous in the known processes and devices that in particular differences in the vessel height are not taken into consideration or taken in consideration disadvantageously in similar vessels. Also in the case of the filling of similar bottles they are not identical. While production-technology deviations are relatively small in glass bottles and the aging of the bottles does not have any noticeable influence on the bottle height, considerable deviations are possible in plastic bottles, in particular as regards the bottle height. A compensation of these deviations is of considerable importance for PET bottles which are to be re-used for ecological reasons. In addition to the height, also the shape of the bottle, in particular in the shoulder area between bottle neck and bottle body, is changed due to the shrinkage of PET bottles due to aging phenomena, heat treatments, flushing processes or the like, whereby the volume of the bottles is also influenced.

In the case of a metering filling fixture, the nominal value is in each case filled even with different bottle sizes, but there are considerably variations in the filling level due to the shrinkage of the bottles. The consumer is confused by the rather non-uniform filling of the bottles. If the filling level is at a higher level in the bottle, this bottle seems to have more content. In the case of a filling level disposed at a lower level in the bottle, there seems to be less liquid in the bottle. Consequently, bottles with a low filling level will only be accepted by the consumer to a lesser degree, and, despite the respectively identical amount of liquid, bottles with a low filling level are not purchased.

In the processes and devices according to DE 3 713 015 C2 and EP 0222 208 B1 the distance of the bottle opening with respect to the filler spout is determined, and the same afterflow volume results for all bottles. Therefore it is possible with bottles with considerable height variations, such as PET bottles, that the actual values of the filled amounts of liquid are outside the legally tolerated limits. A compensation of the height variations is not possible in these known processes and devices.

Due to the constant distance between base of the bottle and filler spout a compensation of height differences with similar bottles is also not possible in the process and the device according to DE 3 019 489 C2. Due to the increased inner pressure of plastic bottles, they are inflated, whereby the volume is considerably and uncontrollably changed.

Consequently, the invention is based on the object of improving a process for the filling of a vessel with a liquid of the type mentioned at the beginning and a device for carrying out the process so that the vessels can be filled with small deviations from the nominal value in a simple and cost-efficient fashion so that a compensation of vessel height variations is made possible with similar vessels.

This object is attained by controlling the afterflowing volume of liquid as a function of the vessel height in such fashion that a larger volume of liquid continues to flow in the case of a vessel height which is smaller as compared with a mean vessel height and a smaller volume of liquid continues to flow in the case of a greater vessel height. Since the bottles with a lower vessel height contain too low a volume of liquid, if liquid is filled up to the predetermined filling level, due to the shrinkage of the bottles, in particular in the shoulder area or the shoulder area which, as a whole is at a lower level, an automatic compensation of the volume of liquid is given by the enlargement of the afterflow volume. In the case of larger bottles the afterflow volume is correspondingly reduced so that also in the case of these bottles the nominal value of the filled liquid is approximately reached. In the case of a specific bottle height, the nominal amount of the liquid is achieved by adding the volume of liquid filled up to the filling level and the afterflow volume.

In a simple embodiment of the invention the vessel opening is pressed against a seal associated to an afterflow chamber formed between the vessel opening and the valve prior to the reaching of the filling position, the vessel opening displacing the seal in the direction of the filler spout until the definitive distance is reached, and the volume of the afterflow chamber is thus changed as a function of the vessel height. In this fashion, an automatic compensation of height tolerances is carried out due to the displacement of the seal and thus the variation of the volume of the afterflow chamber. In the case of larger bottles the seal is displaced more into the direction of the filler spout than in the case of smaller bottles. The volume of the afterflow chamber is correspondingly smaller with larger bottles than with smaller bottles. The displaceability of the seal and thus the variation of the volume of the afterflow chamber are selected in such fashion that practically all height tolerances can be taken into consideration with similar vessels.

In an advantageous embodiment of the invention the afterflow chamber is at least partly formed by a sliding sleeve disposed between vessel opening and filler spout, at whose lower end a seal being in sealing abutment with the vessel lifted into the filling position is provided. Depending upon the height of the vessel, the sliding sleeve is more or less displaced in the direction of the filler spout, and the volume of the afterflow chamber is thus changed. Upon the lifting of the vessel by means of the lifting means, the vessel opening gets into abutment with the seal and, together with it, lifts the sliding sleeve until the filling position is reached.

In this connection the sliding sleeve is at least partly formed of an elastic material in an embodiment of the invention. Upon the lifting of the vessels, the sliding sleeve is displaced in the direction of the filler spout and the part of the sliding sleeve made of elastic material is deformed to be adapted to the lift of the vessel. After removal of the vessel, the sliding sleeve is again extended to its original size.

In another embodiment the sliding sleeve is mounted axially movably at on the filler spout. In this case, the sliding sleeve is displaced along the filler spout upon the lifting of the vessel. In order to facilitate the sealing between filler spout and sliding sleeve it is of advantage if the sliding sleeve is slipped onto the filler spout from the outside.

It is furthermore advantageous if the sliding sleeve is shaped to at least one centering bell receiving the vessel opening. Due to the integrated design of centering bell and sliding sleeve the structure of the device is considerably simplified. A centering of the vessel opening with respect to the filler spout is implemented by means of the centering bell.

In order to connect the vessel tightly with the filler spout, for instance in a counter-pressure filling fixture, it is advantageous if an inner seal is disposed between filler spout and sliding sleeve in the filling position of the vessel. It reinforces and secures the sealing between filler spout and sliding sleeve so that no liquid or gases get lost in a counter-pressure filling fixture.

In order to fix the distance between base of the vessel and filler spout in simple fashion, a lift limiting stop is disposed at least for fixing the filling position of the lifting means. Further stroke limiting means are possible for a flushing position or further positions necessary for the filling process of the vessel.

The outer diameter of the discharge spout is advantageously at least somewhat larger than the inner diameter of the vessel opening. In the case of a pretensioning of the vessel a sealing force axially directed towards the vessel opening is generated in this fashion proportionally to the increase in pressure in the vessel by the annular surface formed above the seal of the centering bell in the area of the sliding sleeve. In the case of instable, thin-walled and pressure-sensitive vessels, e.g. PET bottles, the empty and instable bottle is first of all only pressed slightly on the seal of the centering bell for sealing and only during pretensioning the sealing force increases, the loadability of the bottle increasing at the same time due to the increase in the inner pressure.

In an advantageous further development of the invention the filler spout is surrounded by a concentric annular chamber for receiving the sliding sleeve. Due to the arrangement of the seal between filler spout and sliding sleeve, it can also encompass the filler spout with a radial distance. A sealing with respect to the annular chamber can be achieved e.g. by means of the O-ring seal, upon the slipping of the sliding sleeve onto the filler spout.

In this connection it is furthermore of advantage if an outer seal vertically staggered with respect to the inner seal is provided on the inner side of an outer wall surface of the annular chamber, which seals the sliding sleeve before the inner seal upon the lifting of the vessel into a flushing position. In this fashion, the vessel is already sealed against the atmosphere before the filling position is reached.

It is furthermore of advantage if an opening gap to the annular chamber is formed between sliding sleeve and filler spout in the flushing position. If the annular chamber has a connecting opening to a flushing duct or the like, a flushing of the vessel with vapor and/or inert gas, e.g. $CO_2$, through the opening gap is possible prior to the filling. An at least partial evacuation and repetition of the flushing process is furthermore also possible through the opening gap.

In order to make a simple degassing of the vessel during filling and a determination of the filling level of the liquid in the vessel possible, it is advantageous if a return gas tube projecting from the filler spout is disposed coaxially to the filler spout.

In another embodiment of the invention a filling level probe is disposed coaxially to the return gas tube for the determination of the filling level.

In order to make a first sealing of the vessel opening with the centering bell possible, it is advantageous if, for the acting of force on the centering bell in the direction of the vessels, springs are provided on guide rods guiding the centering bell. In this fashion, the friction between sliding sleeve and filler spout can moreover be overcome by the acting of force on the centering bell. The sliding sleeve is displaceable alone by the springs by the filler spout together with the centering bell without an additional lowering means.

In order to make a flow of the liquid from the filler spout through the variable afterflow chamber into the vessel possible, which is as free from obstacles as possible, it is advantageous if the filler spout is concically enlarged at its end in the direction of the vessel, and the sliding sleeve is conically narrowed below the filler spout at its inner side in the direction of the vessel.

The solutions suggested according to the invention and advantageous examples of embodiment of it will be explained and described in the following by means of the Figs. represented in the drawings.

Figures 1, 2:
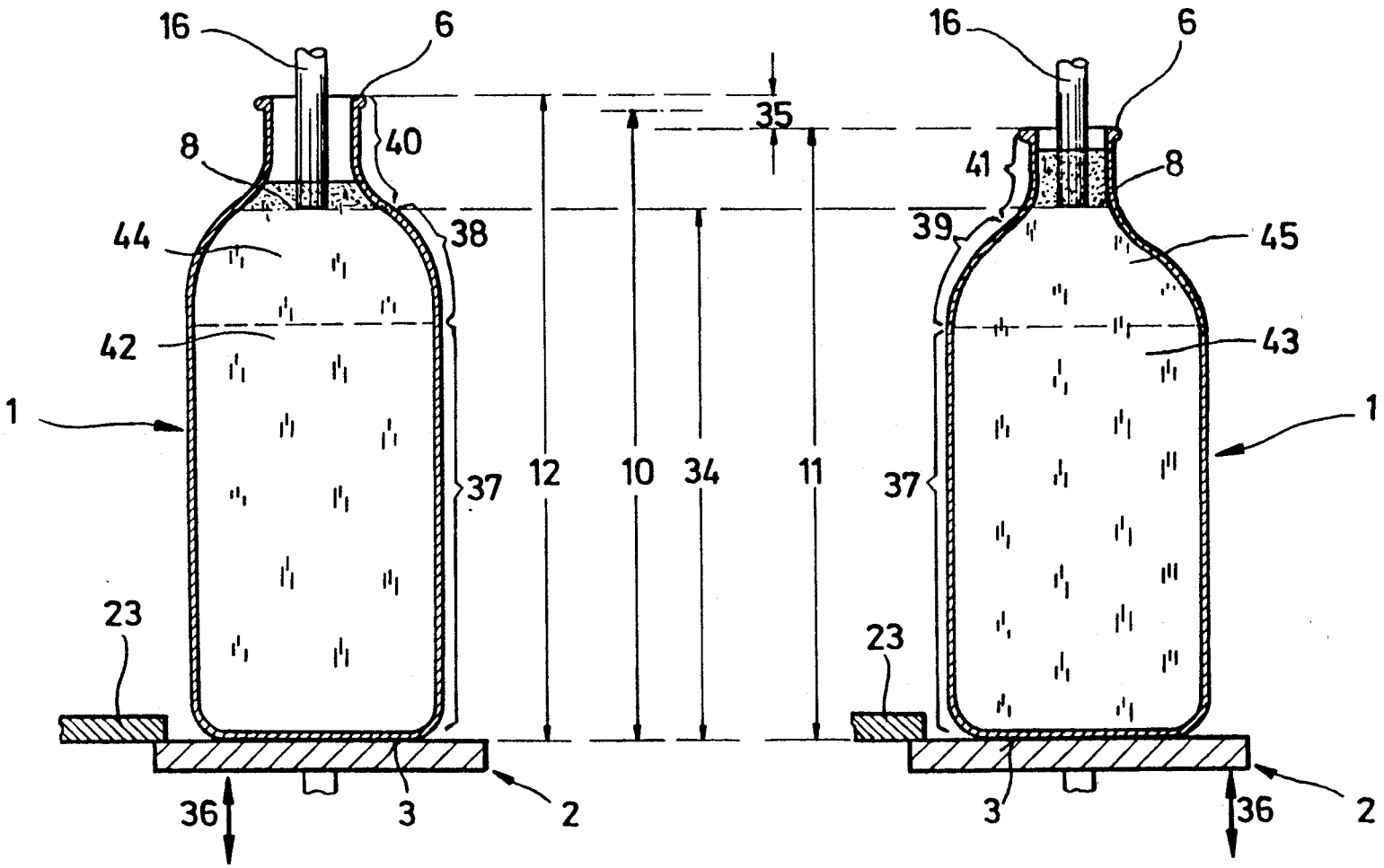
FIG. 1 shows a filled vessel with above-average vessel height.
FIG. 2 shows a filled vessel with below-average vessel height.

Two different vessels 1 are represented in FIGS. 1 and 2, which can be lifted and lowered in the directions 36 by means of a lifting means 2.

The lifting means 2 comprises a substantially horizontal lifting plate on which the vessel 1 is placed with its base 3. A filling position of the vessel 1 is determined by means of a lift-limiting mechanical stop 23. Only a return gas tube 16 is represented of a filling fixture for the filling of the vessels 1 with a liquid for the sake of simplification. It is introduced through a bottle opening 6 into the bottle in the case of bottle-like vessels 1. The lower end of the return gas tube 16 introduced into the bottle determines a filling level 8, up to which liquid is filled into the bottle 1. Each bottle 1 is disposed with its base 3 at a distance 34 from the filling level 8 by means of the lift stop 23.

A bottle 1 with a height 12 is represented in FIG. 1 and a bottle 1 with a height 11 is represented in FIG. 2. A plurality of similar bottles 1 vary as regards their heights from the minimum height 11 to the maximum height 12 with a mean height 10. In the examples represented in FIG. 1 and FIG. 2 a maximum difference 35 in the vessel height results in this fashion.

The filling level 8 is the same for all bottles 1. To the volume of liquid filled up to the filling level 8 an afterflow volume resulting for a bottle 1 with average height 10 must be added, which is described in connection with FIG. 3. Afterflow volume and volume of liquid filled up to the filling level 8 amount to the nominal amount of filling for an average bottle.

The substantially cylindrical bottle bodies 37 represented in FIGS. 1 and 2 are substantially identical for both bottles so that the volumes of liquid 42 and 43 filled therein are substantially of equal size. A shoulder section 38 or 39 provided between bottle neck 40 or 41 has the greatest deviations in the case of similar bottles. The filling level 8 is located within the conical shoulder sections 38 and 39. The volumes of liquid 44 and 45 are different, the volume of liquid 44 being greater than the volume of liquid 45, which is also caused by the cylindrical lower area of the shoulder section 38, which is not present in the shoulder section 39.

Due to the bottle height 12 of the bottle 1 of FIG. 1, the afterflow volume (represented by the speckled area) is smaller than in the bottle 1 of FIG. 2 with the bottle height 11. Due to the greater afterflow volume a compensation of the smaller volume of liquid 45 in the shoulder section 39 can be achieved in the bottle 1 of FIG. 2. The volumes of liquid 44 or 45 with the corresponding afterflow volumes result substantially in a volume of liquid which, together with the substantially identical volumes of liquid 42 and 43 of the bottle bodies 37, amounts to the nominal amount of filling of the bottles 1.

Figure 3:
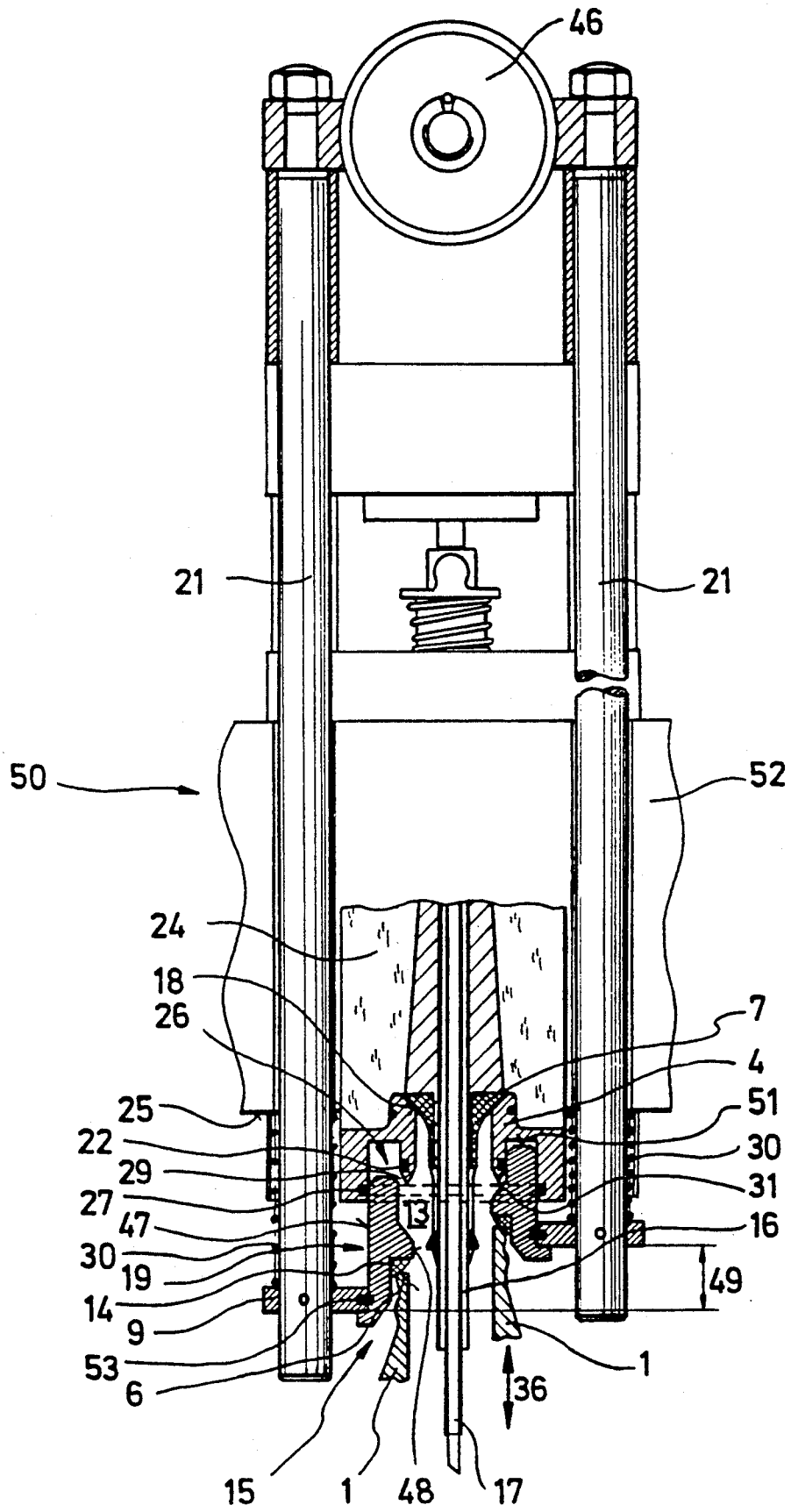
FIG. 3 shows the device according to the invention for the filling of the vessels.

The device 50 according to the invention for the filling of a vessel with liquid is represented in FIG. 3. The device comprises a filler spout 4 and two laterally disposed, vertically displaceable (arrow 36) guide rods 21 to which a centering bell 15 is affixed.

A return gas tube 16 is disposed substantially in parallel to and centrally between the guide rods 21, and a filling level probe 17 is disposed coaxially to it. They are introduced into the opening 6 of a bottle-shaped vessel 1. The bottle 1 is represented in two parts, the left half showing a bottle in the flushing position and the right half a bottle in the filling position. The bottle in the filling position is disposed by a distance 49 closer to a filler spout as compared with the bottle in the flushing position.

The centering, bell 15 comprises a guide flange 9 extending perpendicular to the guide rods 21. Flanges 9 are formed with openings for receiving the guide rods, while their upper sides and a lower side 25 of a filling tank 52, serve as an abutment for springs 30 provided on the guide rods. Movement of the guide rods is guided by a cam roller 46 through a corresponding opening in the filling tank 52. A sliding sleeve 19 designed in one piece with the centering bell 15 extends perpendicular to the guide flange 9 between the guide rods 21. The sliding sleeve 19 is secured to the guide flange 9 at its lower end and extends upwardly with its outer side 47 facing the guide rods 21 substantially in parallel to them. The sliding sleeve 19 is substantially designed as a hollow cylinder and is inserted from below into the approximately annular guide flange 9 so that its collar-like lower end is in abutment with the guide flange. A holding ring 53 is disposed between guide flange and sliding sleeve 19.

The interior of the sliding sleeve 19 has a step-like projection 48 at whose lower side a seal 14 is provided. The opening 6 of the bottle 1 is in sealing abutment with this seal. The inner diameter of the sliding sleeve 19 below the seal 14 is greater than the outer diameter of the opening 6 of the bottle 1. The inner diameter of the sliding sleeve 19 at the level of the projection 48 is less than the inner diameter of the opening 6 or of the same size.

The projection 48 has a portion extending in the direction of the filler spout 4 and in parallel to the cylindrical outer surface 47, which then adjoins a portion bent upwardly and outwardly at an angle of approximately 45° C. The projection ends in a portion of the sliding sleeve 19 with constant wall thickness. The wall thickness of the sliding sleeve above the projection 48 is greater than the wall thickness below this projection. This means that the inner diameter of the sliding sleeve 19 above the projection 48 is, on the one hand, smaller than the inner diameter adjacent to the bottle opening 6 and, on the other, greater than the inner diameter of the filler spout 4 and the bottle opening 6. Due to the design of the projection 48 a conical or funnel-shaped narrowing of the sliding sleeve 19 pointing in the direction of the opening 6 of the bottle 1 results.

The upper end 51 of the sliding sleeve 19 tapers from the inner side and the outer side of the sliding sleeve, which taper ends in a flat surface extending perpendicular to the outer side 47. Due to this, the upper end 51 has a smaller transverse cross-section than the upper wall thickness of the sliding sleeve 19.

The filler spout 4 is disposed above the sliding sleeve 19. It comprises a hollow cylinder closable by means of a valve seat 18 and a vertically movable valve 7, in which return gas tube 16 and filling level probe 17 are coaxially disposed. Liquid 24 flows from the filling tank 52 into the bottle 1 through the hollow cylinder of the filler spout 4, if the valve 7 is opened.

Concentric with to the hollow cylinder of the filler spout 4, is an annular chamber 26 into which the sliding sleeve 19 can be inserted. The inner diameter of the hollow cylinder of the filler spout 4 is substantially equal to the inner diameter of the bottle opening 6. The outer diameter of the hollow cylinder or the inner diameter of the annular chamber 26 corresponds substantially to the inner diameter of the upper section of the sliding sleeve 19. The outer diameter of the annular chamber 26 corresponds to the outer diameter of the sliding sleeve 19.

An end 31 of the filler spout 4, which points towards the sliding sleeve 19 is designed in tapered fashion in the direction of the bottle 1. As a result of the shape of the upper end 51 of the sliding sleeve 19, sliding sleeve 19 is guided into the annular chamber 26. With the sliding sleeve completely inserted into the annular chamber the upper section of the sliding sleeve completely fills the annular chamber, the upper end 51 touching the bottom of the annular chamber and the end 31 of the filler spout being in abutment with the projection 48.

Two seals 22 and 27 are disposed in the annular chamber 26. The inner seal 22 is provided in the inner wall of the annular chamber, which is the outer wall of the hollow cylindrical part of the filler spout 4 and seals with the inner surface of the upper section of the sliding sleeve 19. The outer seal 27 is provided in the inner side of the outer wall of the annular chamber 26 and is disposed at a level lower than the inner seal 22. Both the inner seal 22 and the outer seal 27 are designed as annular sealing elements, i.e. O-rings.

When the bottle 1 is lifted into the flushing position as shown on the lefthand side of FIG. 1, the interior of the sliding sleeve 19, and thus the interior of the bottle l, is sealed with respect to the atmosphere by the outer seal 27. When the bottle 1 is lifted up to its filling position as shown at the righthand side of FIG. 1, the sliding sleeve 19 is then inserted into the annular chamber 26 so that it is now sealed both by the inner seal 22 and the outer seal 27.

Due to the vertically staggered arrangement of outer seal 27 and inner seal 22 and due to the arrangement of the end 31 of the filler spout 4 just above the outer seal 27, an opening gap 29 is formed between the upper end 51 of the sliding sleeve 19 and the end 31 of the filler spout 4 when the bottle 1 is in the flushing position. This means that the bottle 1 is sealed by the seal 14 within the sliding sleeve and by the outer seal 27 with respect to the outer space and is in communication with the annular chamber 26 in the flushing position. In the filling position, the bottle 1 is sealed both with respect to the outer space and the annular chamber 26 by the seal 14, the inner seal 22 and the outer seal 27.

A variable afterflow chamber 13 is formed by the inner surface of the sliding sleeve 19, the interior of the hollow cylindrical part of the filler spout 4 and partly by the interior of the bottle neck represented in FIGS. 1 and 2. Liquid contained in the afterflow chamber 13 is emptied into the bottle upon termination of the liquid supply upon the reaching of the filling level 8 by closing the valve 7 or of the return gas valve (not shown) in the bottle.

The process according to the invention is briefly explained in the following by means of the device represented in the drawings.

The filling level 8 is determined according to the invention in such fashion that in the case of a bottle 1 of average bottle height 10 the volume of liquid filled up to the filling level 8 together with the afterflow volume flowing into the bottle 1 from the afterflow Chamber 13 corresponds substantially to the nominal value of the volume of liquid in the bottle.

For filling, the bottle 1 is lifted in the direction of the filler spout by means of the lifting device 2, the distance 34 of the base 3 of the bottle 1 from the filler spout 4 being determined by the lifting stop 23. Before reaching the filling position, the bottle opening 6 first abuts against seal 14 of the sliding sleeve 19. During further lifting of the bottle 1, the seal 14 is pressed onto the bottle opening 6 by the springs 30. The bottle 1 is then raised in a flushing position where its interior is sealed against the atmosphere by the seal 14 and the outer seal 27 of the annular chamber 26. The sliding sleeve 19 is only inserted into the annular chamber 26 so that the interior of the bottle is still connected with the annular chamber 26 by the opening gap 29. In this so-called flushing position, the bottles are flushed with vapor and/or inert gas via chamber 26. A connection of the annular chamber 26 to a flushing duct is not represented in FIG. 3 for the sake of simplification.

After a possibly repeated flushing of the bottle and/or at least a partial evacuation of bottle, the same is lifted further by the lifting means 2 up to the filling position defined by the lift limiting stop 23. In this position, the interior of the bottle is sealed both against the atmosphere and against the annular chamber 26 by the seal 14, the outer seal 27 and the inner seal 22. After opening of the return gas tube 16 by means of a valve not represented in the drawing, the valve 7 is lifted and liquid 24 flows into the bottle through the filler spout 4 and the sliding sleeve 19.

The distance of the filling level 8 with respect to the base 3 of the bottle is determined by means of the return gas tube 16 or the filling level probe 17. If the liquid filled into the bottle 1 reaches the filling level 8, the valve 7 is closed. The liquid still present in the afterflow chamber 13 after the filling level 8 has been reached and which possibly still flows into the afterflow chamber during the closing of the valve 7 flows additionally into the bottle 1 as afterflow volume.

In a bottle height 11 or 12 deviating from the mean bottle height 10, the volume of the afterflow chamber 13, and thus the afterflow volume of the liquid is varied in accordance with the different displacement of the sliding sleeve 19, in particular by means of the larger diameter portion of the sliding sleeve 19, which extends upwardly from the projection 48, which has a larger inner diameter than the bottle neck. In a larger bottle with a bottle height 12, the sliding sleeve 19 is almost completely inserted into the annular chamber 26. The afterflow chamber 13 therefore has a smaller volume, and, after the reaching of the filling level 8, a smaller afterflow volume flows into the bottle.

In the case of a smaller bottle with a bottle height 11, the sliding sleeve 19 is inserted a lesser amount into the annular chamber 26 and only enough so that it is just in abutment with the inner seal 22. The volume of the afterflow chamber 13 is correspondingly enlarged, and, after the reaching of the liquid level 8, a larger afterflow volume flows into the smaller bottle.

After the respective afterflow volume has flowed into the bottles, they are lowered by means of the lifting means 2. The sliding sleeve 19 is withdrawn from the filler spout 4 by the force of the springs 30 which overcome at least the friction between the sliding sleeve and the filler spout. The sliding sleeve is lowered down to its starting position by both the spring and the force of the centering bell 15 encompassing the sliding sleeve 19.

Due to the volume variability of the afterflow chamber 13 as a result of the vertical adjustability of the sliding sleeve 19 and its inner structure, the afterflow volume is determined in such a fashion that in the case of vessel tolerances which are inevitable in practice, in particular as regards the vessel height, the deviations in the filled liquid volume can be reduced in simple fashion as compared with conventional level filling fixtures. The deviations in the vessel height caused by production or aging are compensated for according to the invention. The invention proves to be advantageous, particularly in view of returnable plastic bottles, e.g. PET bottles. After a few purchase-return cycles, height differences of up to 8 mm can be detected in these bottles which result in particular from shrinkage of the bottles due to the influence of heat during the cleaning process.

There are certainly deviations in the definite height of the filling level 8 in the different bottles due to the different afterflow volumes of the liquid; however, these deviations are advantageously smaller than in a metering filling fixture, while the deviations as regards the actual filling volume is at the same time reduced as compared with filling fixtures which arrange the opening at a fixed distance to the filler spout.

I claim:

1. A method for controlling the total volume of a liquid fed to vessels of varying height in a filling machine for filling the vessels with a liquid, said vessels having a base at a bottom end, an opening at a top end and a mean height as measured from said bottom end, said filling machine having a fixed filler spout for receiving the opening of the vessel in a sealed filling position and a liquid flow valve for controlling the flow of liquid through said spout into said vessel, said method comprising lifting each vessel up toward said filler spout so that its base is a constant distance from the filler spout and its opening is in said sealed filling position below the filler spout, opening the liquid control valve and filling the vessel with the liquid to a predetermined filling level in the vessel measured from its base, thereafter closing the liquid control valve to terminate the flow of liquid to the vessel, an afterflow volume of liquid remaining between said filling level and the valve after the valve is closed, and controlling said afterflow volume of the liquid as a function of the height of the vessel such that the afterflow volume of a vessel having a height more than said mean height is smaller than the afterflow volume for said mean height vessel and for a vessel having a height less than said mean height, the afterflow volume is greater than the afterflow volume for said mean height vessel.

2. The method of claim 1, wherein prior to the vessel reaching said sealed filling position, the opening in the top of the vessel engages with an annular sleeve of variable inner diameter mounted for sliding movement with respect to the filler spout in the direction of movement of the vessel, the inner surface of said sleeve forming with interior of the vessel above said predetermined filling level an afterflow chamber between said level and said valve of variable volume dependent on the distance the opening in the top of the vessel is from the fixed filler spout when in said sealed filling position, said opening being closer to said spout, and the volume of the afterflow chamber being less, the greater the height of the vessel.

3. The method of claim 2, including centering the opening in the top of the vessel with the filler spout with the annular sleeve as the opening engages with said annular sleeve.

4. The method of claim 1, including inserting a return gas tube into the opening of the vessel as it is lifted up into sealed filling position with the filler spout to control the filling of the vessel to said predetermined filling level.

5. The method of claim 1, including inserting a filling level probe into the opening in the top of the vessel as it is lifted up into said sealed filling position with the filler spout to control the filling of the vessel to said predetermined filling level.

6. A device for controlling the total volume of a liquid fed to vessels of varying height in a filling machine for filling the vessels with a liquid, said vessels having a base at a bottom end, an opening at a top end and a mean height as measured from said bottom end, said device comprising a filler spout fixedly mounted on said filling machine adapted to receive the opening in the top of a vessel in a sealed manner, a liquid flow valve for controlling the flow of liquid through said spout, lifting means for lifting a vessel toward said filler spout to bring said opening into a sealed filling position with respect to the filler spout with its base being a constant distance from the filler spout, control means for operating the valve to fill each vessel to a predetermined filling level measured from its base, an afterflow chamber being formed between said level and said valve containing an afterflow volume of liquid after said filling level has been reached and means for varying the volume of said chamber as a function of the height of the vessel such that the volume of the chamber is smaller for a vessel having a height more than said mean height than the volume of the chamber is for a mean height vessel and is larger for a vessel having a height less than said mean height than volume of the chamber is for a mean height vessel.

7. The device of claim 6, wherein the means for varying the volume of the afterflow chamber comprises an annular sleeve of variable inner diameter displaceably mounted for sliding movement with respect to the axis of the filler spout in the direction of movement of the vessel that is engaged by the top of the vessel as it is brought up into said sealed filling position, the inner surface of the annular sleeve forming with the interior of the vessel above said filling level said afterflow chamber, the sleeve being displaced closer to the spout and the volume of the part of the chamber formed by said inner surface of the sleeve being smaller for vessels having a height more than the mean height than for vessels having a height less than the mean height.

8. The device of claim 7, wherein the sleeve includes a seal that seals with the top of the vessel around said opening as it is lifted into the filling position.

9. The device of claim 8, wherein the sleeve is at least partly formed from an elastic material.

10. The device of claim 7, wherein the opening in the vessel is coaxial with the filler spout when the vessel is in said filling position and the sliding sleeve is mounted for axial movement on the filler spout.

11. The device of claim 10, wherein the sleeve includes a centering bell for axially aligning the opening of the vessel with the filler spout as it is lifted into the filling position.

12. The device of claim 7, wherein an inner seal is disposed on an outer surface of the filler spout that seals with an inner surface of the sleeve when the vessel is in the filling position.

13. The device of claim 7, wherein the lifting means includes a stop for keeping constant the distance of the base of each vessel from the filling spout when in the filling position.

14. The device of claim 7, wherein the outer diameter of the filler spout is greater than the inner diameter of the opening of a vessel to be filled by the filling machine.

15. The device of claim 12, wherein the outer surface of the filler spout is surrounded by a concentric annular chamber that receives the annular sleeve.

16. The device of claim 15, wherein an outer seal axially staggered with respect to the inner seal is disposed on an inner surface of an outer wall of the annular chamber which seals with an outer surface of the sleeve as the vessel is lifted towards the filler spout before said inner seal engages with the sleeve.

17. The device of claim 16, wherein, when said outer seal initially seals with said sleeve, a gap is formed between the sleeve and the outer surface of the filler spout to communicate the annular chamber with the interior of the vessel and means for connecting said annular chamber with a source of a flushing gas.

18. The device of claim 10, wherein the control means includes a return gas tube that projects coaxially from the filler spout and into opening of the vessel when the vessel is lifted into the filling position to control said predetermined filling level.

19. The device of claim 18, wherein a filling level probe is disposed coaxially within the return gas tube.

20. The device of claim 7, including guide rods for guiding the sleeve and spring means biasing the sleeve toward the lifting means.

21. The device of claim 7, wherein the filler spout conically enlarges at its end nearest the vessel and the sliding sleeve is conically narrowed below the filler spout at its inner side in the direction of the vessel.

22. The device of claim 7, wherein said part of the afterflow chamber formed by the inner surface of the sleeve has a diameter greater than the inner diameter of the opening of the vessel.

* * * * *